US005615936A

United States Patent [19]

Simmons et al.

[11] Patent Number: 5,615,936

[45] Date of Patent: Apr. 1, 1997

[54] CORNER DESK OR LIKE UNIT

[75] Inventors: Danny R. Simmons, 5637 N. Key, Sebring, Fla. 33872; W. Larry Johnson, Sebring, Fla.

[73] Assignee: Danny R. Simmons, Sebring, Fla.

[21] Appl. No.: 562,526

[22] Filed: Nov. 27, 1995

[51] Int. Cl.[6] ..... A47B 97/00; A47B 88/00

[52] U.S. Cl. ..... 312/238; D6/422; D6/510; 312/239; 312/194; 312/330.1

[58] Field of Search ..... 312/194, 195, 312/238, 239, 257.1, 312, 330.1; D6/422, 509, 510

[56] References Cited

U.S. PATENT DOCUMENTS

| | | | |
|---|---|---|---|
| D. 116,574 | 9/1939 | Pellegrin et al. | 312/238 X |
| D. 148,776 | 2/1948 | Fay | 312/194 X |
| 1,700,201 | 1/1929 | Langford et al. | 312/195 |
| 2,386,092 | 10/1945 | Cornish | 312/239 X |
| 2,533,155 | 12/1950 | Von Hacht | 312/194 |
| 3,345,311 | 10/1967 | Bears . | |
| 4,080,022 | 3/1978 | Canfield et al. | 312/239 |
| 4,323,291 | 4/1982 | Ball | 312/194 |
| 4,345,803 | 8/1982 | Heck | 312/194 |
| 4,461,520 | 7/1984 | Alneng | D6/510 X |
| 4,559,877 | 12/1985 | Waibel | 108/64 |
| 4,768,845 | 9/1988 | Yeh | 312/257.1 |

FOREIGN PATENT DOCUMENTS

| | | | |
|---|---|---|---|
| 512502 | 5/1955 | Canada | 312/194 |
| 1761 | 5/1902 | United Kingdom | 312/195 |
| 591288 | 8/1947 | United Kingdom | 312/194 |
| 2169492 | 7/1986 | United Kingdom | 312/238 |

OTHER PUBLICATIONS

Popular Science, "Kitchen Corner", Oct. 1954, p. 118.

*Primary Examiner*—Peter M. Cuomo
*Assistant Examiner*—James O. Hansen
*Attorney, Agent, or Firm*—Charles J. Prescott

[57] ABSTRACT

A work station and drawer module, preferably adapted for a corner, including a horizontal work or support surface and supporting connected upright panels to define an enclosure. A front panel of the enclosure includes a front opening for receiving a horizontally slidably mounted angular drawer. The drawer has a front facing panel which substantially covers the front opening when the drawer is closed. The upright drawer side panels are angularly oriented with respect to the front facing panel at an acute angle of in the range of about 30° to 60° and slidably supported within the work station drawer module and like units so that the drawer moves in a horizontal linear path at the acute angle to the front opening. The drawer may be structured to hold upright files, to support office equipment and for general storage.

4 Claims, 4 Drawing Sheets

CORNER DESK OR LIKE UNIT

BACKGROUND OF THE INVENTION

1. SCOPE OF INVENTION

This invention relates generally to a work station, desk module and like units, and more particularly to such a unit having an angularly oriented drawer cooperatively constructed in combination with such units for linear movement of the drawer at an acute angle with respect to the front opening receiving the drawer.

2. PRIOR ART

Applicant is aware of numerous work stations and desk modules oriented for corner use as follows:

| | |
|---|---|
| Ball | 4,323,291 |
| Heck | 4,345,803 |
| Yeh | 4,768,845 |
| Bears | 3,346,311 |
| Ball | 4,343,291 |
| Waibel | 4,559,877 |

Upon examination of these prior art units, none provide a drawer arrangement which, when withdrawn or opened, does not interfere with the user positioned at the work station. Those units which include drawers are of a conventional nature wherein each drawer moves linearly orthogonally with respect to the mating front surfaces of the work station or desk and drawer front panel. To applicants' knowledge, no enclosure provides such an angularly oriented drawer with linear movement about an angular orientation to the front surface of the unit drawer.

The present invention provides, in one broad embodiment, an angular drawer module having an enclosure structured to support and facilitate horizontal linear movement of an angular drawer at an acute angle with respect to the front surface of the enclosure. The angular drawer is structured having angularly oriented side panels with respect to its front facing panel. Various specific embodiments of this broad angular drawer concept are incorporated into modules, corner work stations, kitchen cabinetry and wall units as well.

BRIEF SUMMARY OF THE INVENTION

This invention is directed to a work station and drawer module, preferably adapted for an inside corner, including a horizontal work or support surface and supporting connected upright panels to define an enclosure. A front panel of the enclosure includes a rectangular front opening for receiving a horizontally slidably mounted angular drawer. The drawer has a front facing panel which substantially covers the front opening when the drawer is closed. The upright parallel drawer side panels are angularly oriented with respect to the front facing panel at an acute angle of in the range of about 30° to 60° and are slidably supported within the work station drawer module and like units so that the drawer moves in a horizontal linear path at the acute angle to the front opening. Each angular drawer may be structured to hold upright files, to support office equipment, for general storage and the like.

It is therefore an object of this invention to provide an angular drawer module having a drawer which moves into and out of an enclosure at an acute angle with respect to the front upright surface of the enclosure.

It is yet another object of this invention to provide a corner work station having a horizontal central working surface positionable into the corner and also having an angularly movable drawer which moves generally parallel to the side of the user facing the work station without interference.

It is yet another object of this invention to provide a corner work station, an angular drawer module, kitchen cabinetry, a free-standing desk and like units which incorporate an angular drawer supported for linear horizontal in and out motion at an acute angle with respect to an upright front facing panel of the drawer.

In accordance with these and other objects which will become apparent hereinafter, the instant invention will now be described with reference to the accompanying drawings.

DETAILED DESCRIPTION OF THE INVENTION

Figure 1:
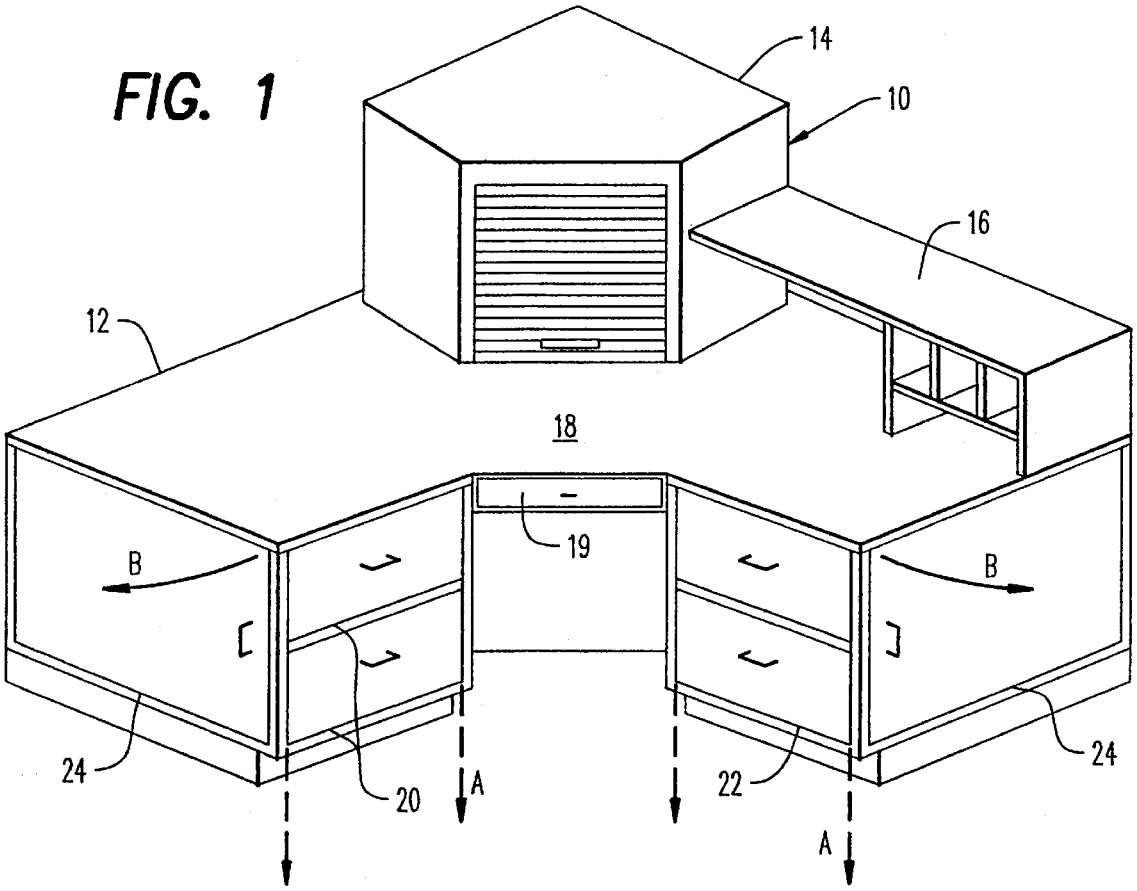
FIG. 1 is a perspective view of one embodiment of the invention in the form of a corner work station.
Figure 2:
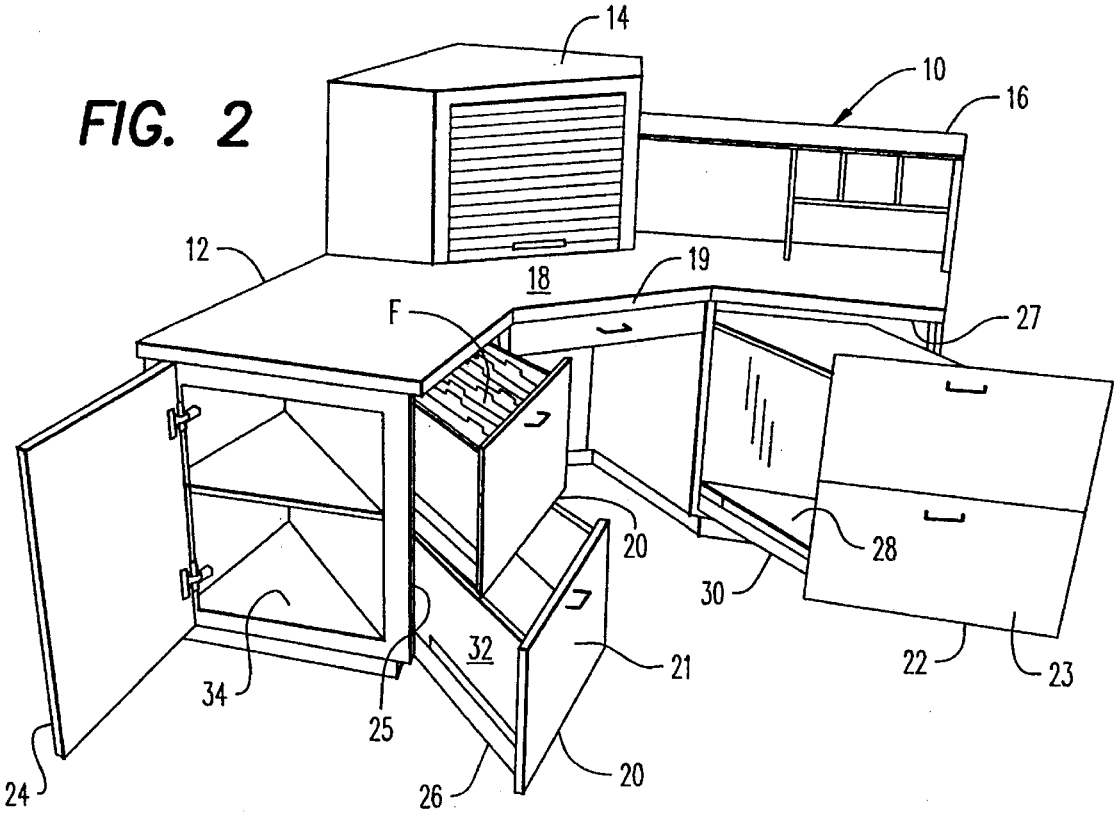
FIG. 2 is a view similar to FIG. 1 with its angular drawers and storage area open.
Figure 3:
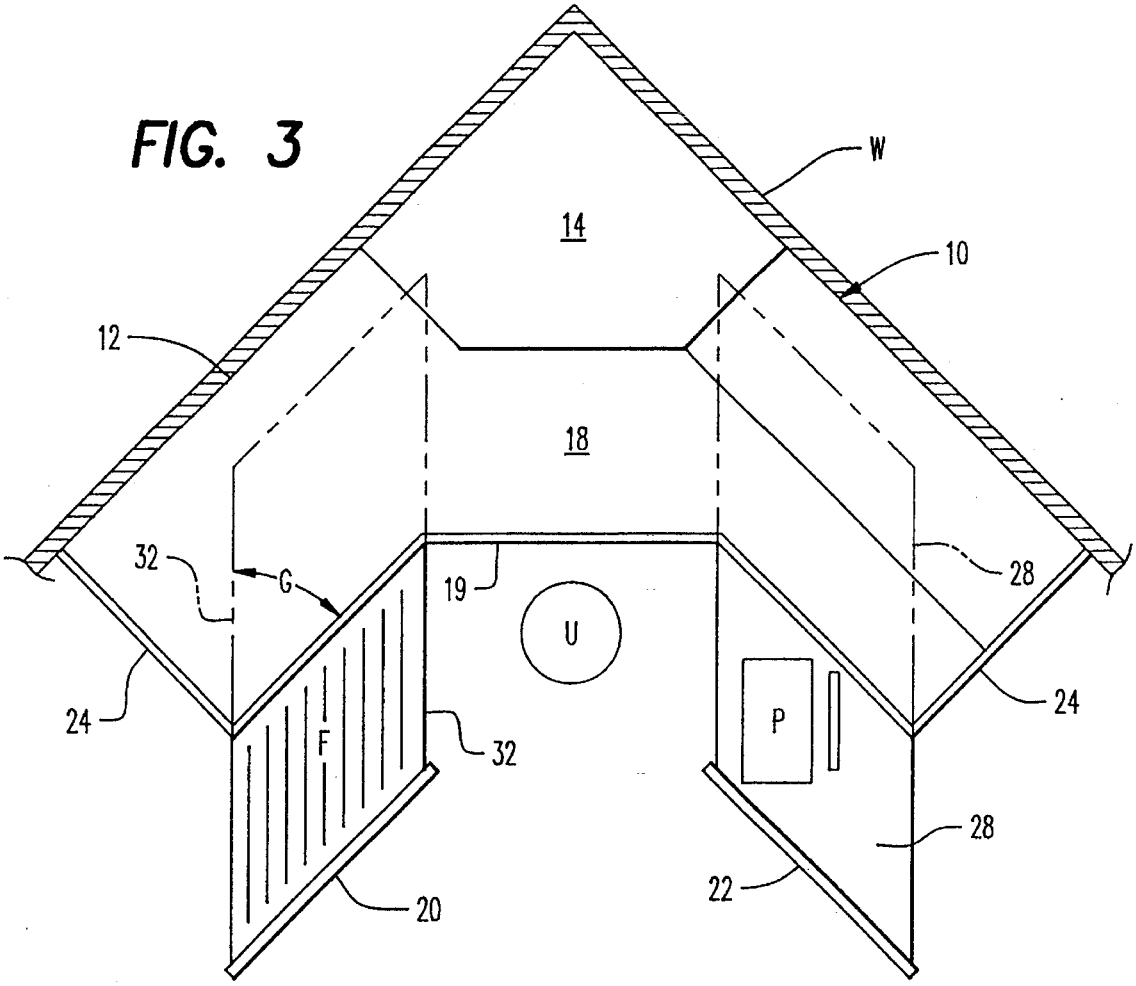
FIG. 3 is a top plan view of FIG. 2.

Referring now to the drawings, and particular to FIGS. 1 to 3, one embodiment of the invention is shown generally at numeral 10 in the form of a corner work station. This embodiment 10 is structured to fit into the orthogonal walls W seen in FIG. 3 which define an inside corner, such as a corner of a room or office area.

The corner work station 10 includes a desk 12 having a horizontal working surface 18 supported by connected upright generally flat desk panels of the desk 12 as shown to define an enclosure below the working surface 18. A user is typically positioned at circle U facing a front margin 19 of the working surface 18. Office equipment such as a computer and monitor may be positioned atop the work surface 18 or enclosed within a tower 14 as shown.

The majority of such corner work stations 10 are structured so that the front facing margin or surface 19 is oriented at an acute angle to each wall W of 45° for symmetry. Side doors 24 and the associated supposing structure of the desk 12 are thus oriented orthogonally with respect to the corresponding wall W as shown for aesthetic continuity.

The working station 10 also includes angular drawers 20 and 22 each having front facing panels 21 and 23, respectively, which conceal similarly sized rectangular front openings 25 and 27, respectively, formed into the corresponding angled front surfaces of the desk 12. As shown, angular drawers 20 and 22 are structured in their interior volume to support upright files F and various items for storage. Angular drawer 22 includes a lower and an upper surface 28 for holding such office equipment as a printer P as shown in FIG. 3.

Each of the angular drawers 20 and 22 are supported on well-known spaced apart two-part glides 26 and 30, respectively. These glides 26 and 30 are typically structured having two elongated elements held together by rollers, the outer element being connected to two spaced upright desk panels of the desk unit 12 while the inner movable portions of the glides 26 and 30 are connected to upright side panels, edges or surfaces 32 (typ.) of each angular drawer 20 and 22 as shown.

Each of the angular drawers 20 and 22 are structured having these parallel side panels or surfaces 32 (typ.) oriented at an acute angle of G in FIG. 3 with respect to the front openings 25 and 27 of the desk 12 and the upright drawer facing panels 21 and 23. This angle G is preferably about 45° and may be in the range of about 30° to 60°, depending upon the angular configuration of the corner walls W or as desired.

By this arrangement, the angular drawers 20 and 22 may be withdrawn and closed in the direction of arrows A in FIG. 1 in a linear movement which is oriented at an acute angle G with respect to both the walls W and the front openings of desk 12. Thus, a user positioned at circle U at work may thus remain in that position while having full access to the contents of each of the drawers 20 and 22 without interfering with drawer movement.

As best seen in FIG. 2, by having the desk 12 structured with its end margins (and side doors 24 when closed) orthogonal to the walls W as shown, a triangular configured storage area 34 at each end of the desk 12 enclosed by doors 24 is also provided.

Figure 4:
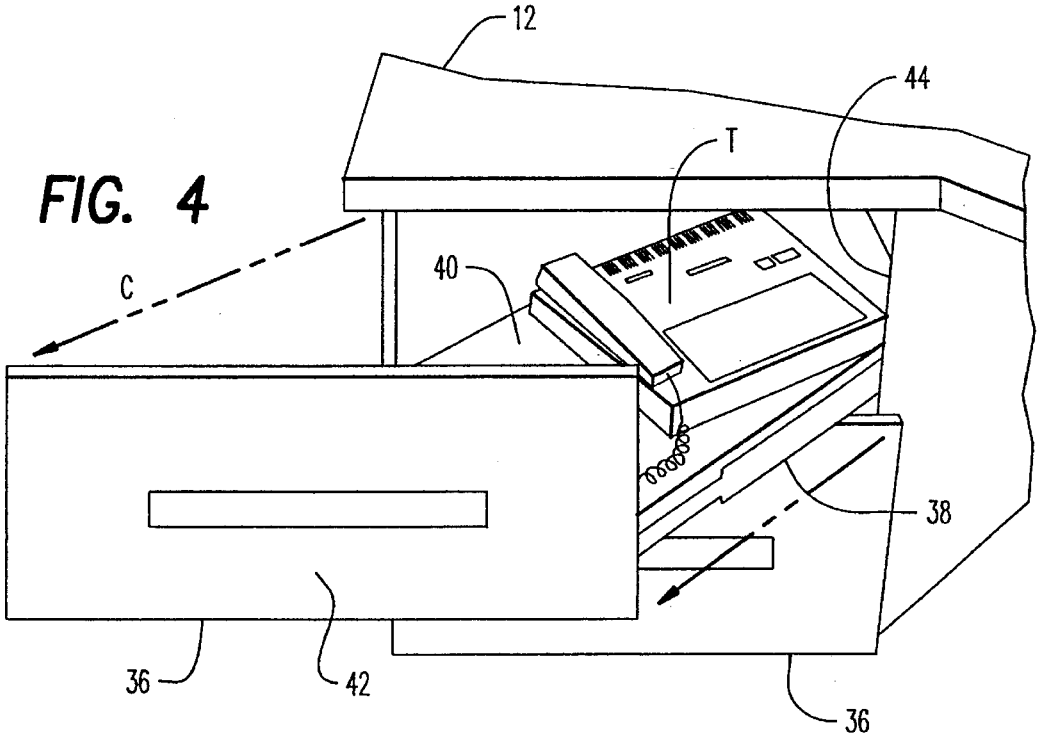
FIG. 4 is an enlarged perspective view of another embodiment of the invention.

Referring now to FIG. 4, an alternate embodiment of the angular drawers is there shown at 36. As previously described, two-part glides 38 support each angular drawer 36 which provides a horizontal intermediate work support 40 for such equipment as a telephone answering machine T. Movement of the angular drawer 36 and its front facing panel 42 in the direction of arrow C with respect to front opening 44 provides access to this equipment T. Of course, a virtually unlimited configuration of the internal volume defined by each of these angular drawers is within the scope of this invention.

Figure 5:
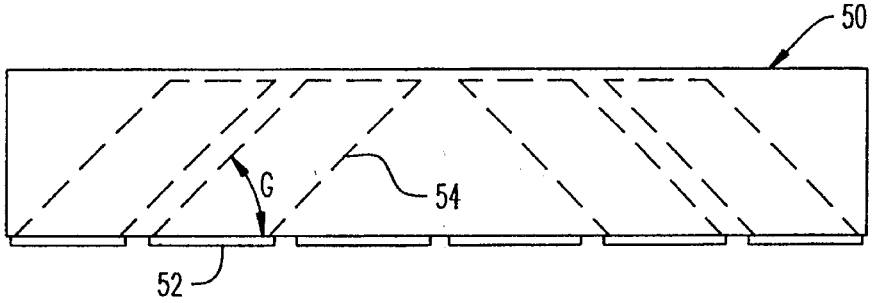
FIG. 5 is a top plan view of FIG. 6.
Figure 6:
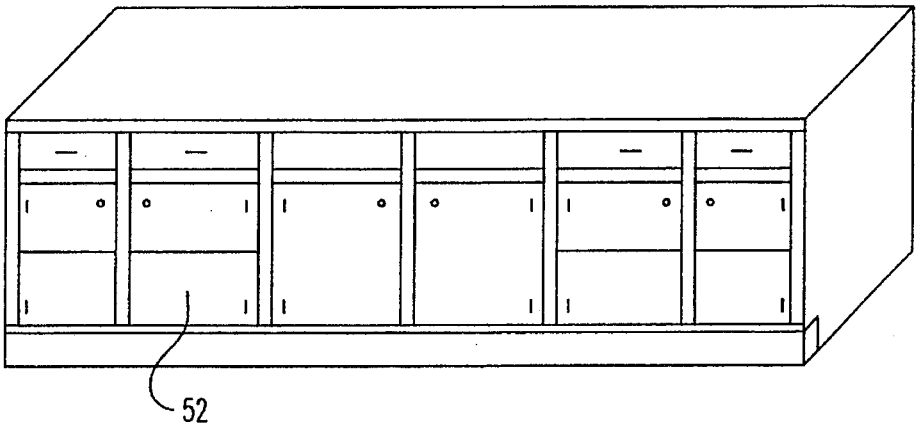
FIG. 6 is a front perspective view of another embodiment of the invention structured for free-standing use along a wall.

FIGS. 5 and 6 depict another embodiment of the invention at 50 structured having a straight cabinet enclosure having flat parallel upright front and back surfaces and orthogonally oriented upright end surfaces as shown. However, this embodiment 50 includes diagonally structured and oriented drawers 54 having facing panels 52 oriented at an acute angle G with respect to the upright sides of the drawer 54 as shown and previously described.

Figure 7:
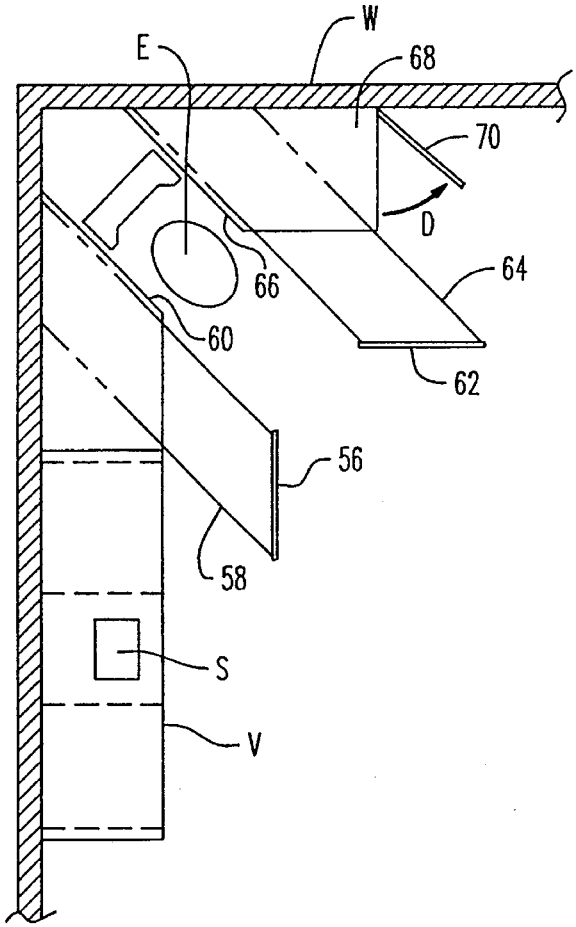
FIG. 7 is a top plan view of still another embodiment of the invention adapted for a corner of a bathroom or lavatory.
Figure 8:
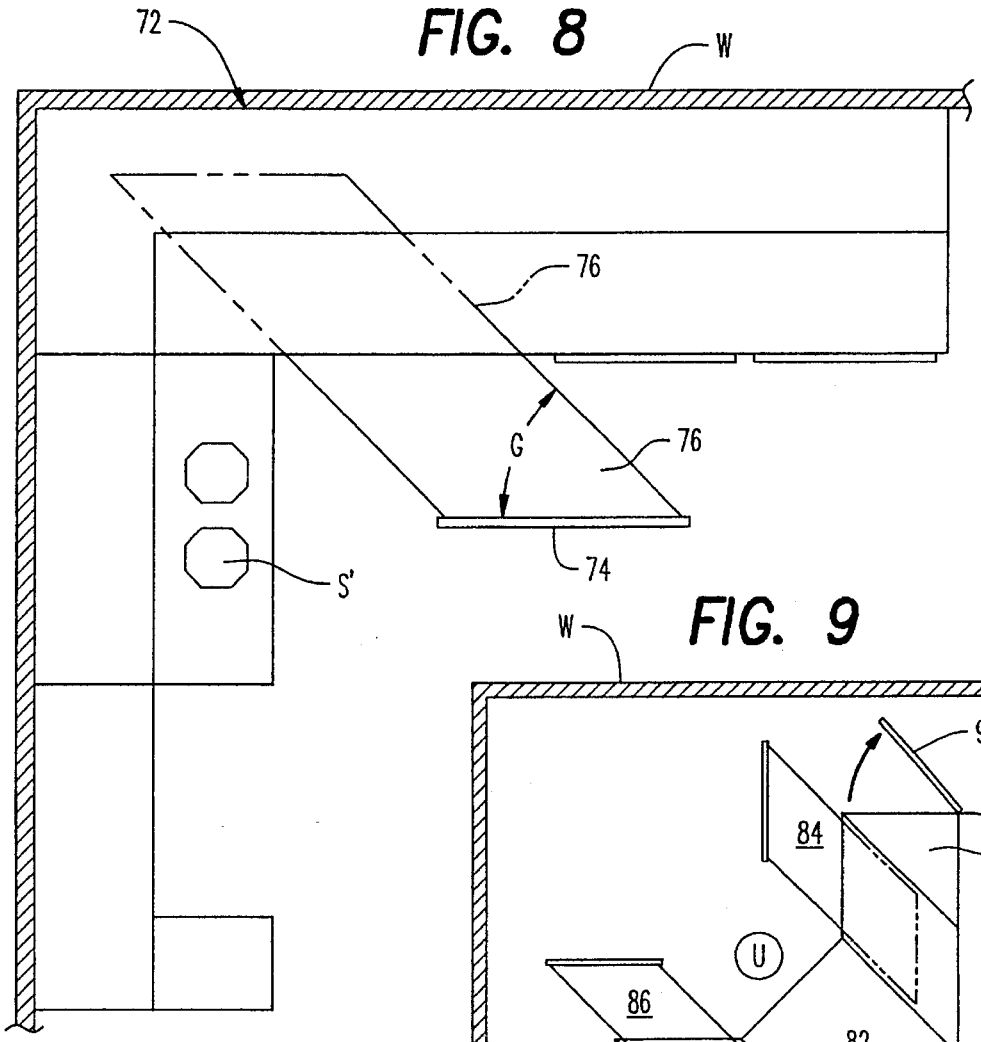
FIG. 8 is a top plan view of still another embodiment of the invention adapted for a corner of a kitchen.
Figure 9:
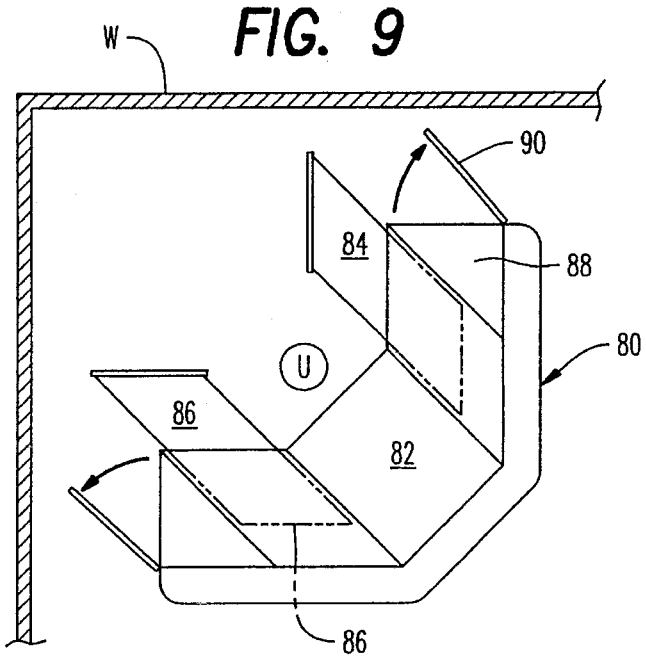
FIG. 9 is a top plan view of yet another free-standing embodiment of the invention.

Several additional embodiments or variations of the inventive concept of this application are shown in FIGS. 7, 8 and 9. In FIG. 7, a lavatory or bathroom arrangement around a corner positioned toilet E symmetrically positioned within corner walls W is shown. One angular drawer 64 having facing panels 62 is positioned within cabinet or enclosure 66 directly against one wall W at an acute angle G of preferably in the range of 45°. An additional triangular storage area 68 accessed by opening door 70 in the direction of arrow D is also provided in part to provide a finished orthogonal upright surface of the cabinet 66 with respect to one wall W.

A second angular drawer 58 is positioned on the other side of the toilet E within cabinet 60 structured as a mirror image of cabinet 66 except with respect to the absence of door 70, cabinet 60 having its working surface and storage area extended by vanity V which typically includes a sink S.

In FIG. 8, another embodiment 72 within the corner walls W of a kitchen arrangement is there shown. Typically, a user faces the sinks S' when cleaning and cooking. Easy access to the angular drawer 76 by withdrawing same at a fixed angle G with respect to front panel 74 makes better utilization of the corner areas of the kitchen cabinets. Front panel 74 is sized to conceal the corresponding front cabinet opening for receiving angular drawer 76 in a conventional sliding manner.

A free-standing unit 80 is shown in FIG. 9 to depict the versatility of the present invention as embodied in such a work station 80. Two angular drawers 84 and 86 are provided on either side of the center section 82 each withdrawable without interference or contact with the user positioned within the circle U. Triangular storage areas 88 accessible by opening doors 90 provides for utilization of space and orthogonal orientation of the upright end panels of this work station 80.

Figure 10:
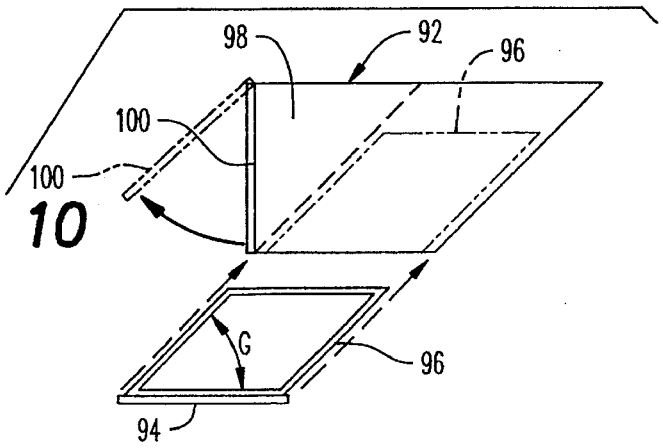
FIG. 10 is a top plan view of an angular drawer module embodiment of the invention.

Lastly, in FIG. 10, a broad embodiment of the invention is shown at 92 in the form of an angular drawer module. This embodiment 92 may be utilized with other various conventionally configured desk and work station components to form, e.g., any one of the embodiments of the invention previously described. This drawer module 92 includes an angular drawer 96 having a front facing panel 94 oriented at an acute angle G with respect to the upright side panels of the drawer 96 as shown. To reiterate, then, the drawer 96 moves in the direction of the arrows at the acute angle G with respect to the back surface of the drawer module 92. This embodiment 92 includes a triangular storage area 98 accessible by movement of door 100 in the direction of the arrow into the position shown in phantom so as to provide an orthogonal upright end surface with respect to the back surface of the module 92 with conventional finished appearance.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A work station comprising:

a center section having a horizontal center work surface defining a front margin facing a user;

two spaced apart side sections extending laterally in either direction from said center section;

each said side section including:

an upright front drawer opening which extends forward at an acute angle of at least about thirty degrees (30° ) with respect to said front margin;

an angular drawer having a generally flat upright facing panel, connected upright parallel drawer panels, an upright back, and a horizontal bottom, said facing panel, said drawer panels and said back, when viewed from above, defining a parallelogram having included angles substantially equal to said acute angle;

a drawer glide means operably connected between each said side section and a corresponding said drawer for horizontal linear movement of each said drawer, said linear movement being in a direction at said acute angle with respect to said front drawer opening whereby said drawers withdraw from said side sections substantially parallel to one another and without user interference;

each said facing panel substantially covering a corresponding said front opening when said drawer is in a closed position.

2. An angular drawer module as set forth in claim 1, wherein:

each said side section further includes a substantially triangular upright storage area having access thereto defined by an upright exposed end surface of said side section which is substantially orthogonal to a corresponding said front drawer opening and being positioned immediately along side of said drawer.

3. An angular drawer module, comprising:

an upper horizontal support surface and connected upright side panels, an openable door orthogonal to a rectangular front drawer opening;

an angular drawer including an upright flat facing panel and connected upright spaced, parallel drawer panels, said drawer, as viewed from above, having an overall shape of a parallelogram with included acute angles of at least about thirty degrees (30° );

drawer glide means operably connected between said side panels and said drawer panels for supporting said drawer for horizontal linear movement of said drawer;

said linear movement being at said acute angle with respect to said front opening;

a substantially triangular upright storage area defined between said door and one said side panel, said triangular storage area positioned immediately along side of said drawer.

4. A work station consisting essentially of:

a center section having a horizontal center work surface defining a front margin facing a user;

two spaced apart side sections extending laterally in either direction from said center section;

each said side section including:

an upright front drawer opening which extends forward at an acute angle of at least about thirty degrees (30°) with respect to said front margin;

an angular drawer having a generally flat upright facing panel, connected upright parallel drawer panels, a back, and a bottom, said facing panel, said drawer panels and said back having a shape in plan view of a parallelogram having included angles equal to said acute angle;

a drawer glide means openly connected between each said side section and a corresponding said drawer for horizontal linear movement of each said drawer;

said linear movement being in a direction at said acute angle with respect to said front drawer opening whereby said drawers withdraw from said side sections substantially parallel to one another and without user interference.

* * * * *